United States Patent [19]

Katz et al.

[11] Patent Number: 4,779,065

[45] Date of Patent: Oct. 18, 1988

[54] MICROWAVE SIGNAL ROUTING MATRIX

[75] Inventors: Allen Katz, Trenton; Michael W. Moreken, Plainsboro, both of N.J.

[73] Assignee: General Electric Company, East Windsor, N.J.

[21] Appl. No.: 43,395

[22] Filed: Apr. 28, 1987

[51] Int. Cl.[4] ..... H01P 1/15

[52] U.S. Cl. ..... 333/101; 333/104; 340/825.83

[58] Field of Search ..... 333/101, 103–105; 340/825, 825.83, 826, 827; 379/248, 291, 292, 306, 335

[56] References Cited

U.S. PATENT DOCUMENTS

| | | | |
|---|---|---|---|
| 3,032,723 | 5/1962 | Ring . | |
| 3,270,299 | 8/1966 | Stapf | 333/105 |
| 3,519,961 | 7/1970 | Bergey . | |
| 3,720,792 | 3/1973 | Resta | 379/292 X |
| 3,813,497 | 5/1974 | Wachs et al. | 333/104 X |
| 3,833,866 | 9/1974 | Boutelant . | |
| 3,982,212 | 9/1976 | Wallington et al. . | |
| 4,316,159 | 2/1982 | Ho | 333/104 |
| 4,399,439 | 8/1983 | Upadhyayula . | |
| 4,697,160 | 9/1987 | Clark | 333/103 |

OTHER PUBLICATIONS

"Fast, Fully-Redundant, 4GHz, 8×8 Microwave Switch Matrix", by Assal et al.

"IF Switch" by Bill Shanney.

*Primary Examiner*—Paul Gensler

*Attorney, Agent, or Firm*—Clement A. Berard; William H. Meise

[57] ABSTRACT

An N×M signal routing matrix has low loss. The N input ports are connected to N input transmission lines, and the M output ports are connected to M output transmission lines. A plurality of interconnects interconnect the input and output transmission lines at their crossing points. The points of connection of the interconnects to any one of the input or output transmission lines are spaced λ/2 (or multiples thereof) apart along the transmission line. Each interconnect includes a transmission line at least λ/2 long, and each includes a short-circuiting switch arrangement capable of short-circuiting the inteconnecting transmission line at point(s) λ/4 (or odd multiples thereof) from the ends of the interconnecting transmission line. In order to form a path for the flow of signal between a selected input port and a selected output port, the switching arrangement of that one interconnect which interconnects the input and output transmission lines corresponding to the selected ports is not short-circuited, and all other switching arrangements of interconnects terminating on one of the corresponding transmission lines are short-circuited. In some embodiments, multiple independent signal paths are available. In some embodiments, redundant paths are provided.

10 Claims, 7 Drawing Sheets

| FROM \ TO | OUTPUT PORT 1 | OUTPUT PORT 2 |
|---|---|---|
| INPUT PORT 1 | SW 330 OPEN<br>SW 350, 430 SHORT<br>SW 450 * | SW 350 OPEN<br>SW 330, 450 SHORT<br>SW 430 * |
| INPUT PORT 2 | SW 430 OPEN<br>SW 330, 450 SHORT<br>SW 350 * | SW 450 OPEN<br>SW 350, 430 SHORT<br>SW 330 * |

* = DOESN'T MATTER

| FROM | TO OUTPUT PORT 1 | TO OUTPUT PORT 2 | TO OUTPUT PORT 3 |
|---|---|---|---|
| INPUT PORT 1 | SW 330 OPEN<br>SW 550, 350, 430 SHORT<br>SW 450, 590 ✱ | SW 350 OPEN<br>SW 550, 330, 450 SHORT<br>SW 430, 590 ✱ | SW 550 OPEN<br>SW 330, 350, 590 SHORT<br>SW 430, 450 ✱ |
| INPUT PORT 2 | SW 430 OPEN<br>SW 590, 450, 330 SHORT<br>SW 350, 550 ✱ | SW 450 OPEN<br>SW 590, 430, 350 SHORT<br>SW 330, 550 ✱ | SW 590 OPEN<br>SW 430, 450, 550 SHORT<br>SW 330, 350 ✱ |

✱ = DOESN'T MATTER

| FROM INPUT PORT 1 | FROM INPUT PORT 2 | TO |
|---|---|---|
| 330,614 OPEN<br>350,430,550,620,692 SHORTED<br>450,590,626,632,694,696 * | 632,692 OPEN<br>330,430,626,694,696 SHORTED<br>350,450,550,590,614,620 * | OUTPUT PORT 1 BY PATH 1 |
| 430,620 OPEN<br>330,450,590,614,626,692 SHORTED<br>350,550,632,694,696 * | 430,626 OPEN<br>330,450,590,620,632,692 SHORTED<br>350,550,614,694,696 * | OUTPUT PORT 1 BY PATH 2 |
| 350,614 OPEN<br>330,550,450,620,694 SHORTED<br>430,590,626,632,692,696 * | 632,694 OPEN<br>350,450,626,692,696 SHORTED<br>330,430,550,590,614,618 * | OUTPUT PORT 2 BY PATH 1 |
| 450,620 OPEN<br>350,430,590,614,626,694 SHORTED<br>330,550,632,692,696 * | 450,626 OPEN<br>350,430,590,620,632,694 SHORTED<br>330,550,614,692,696 * | OUTPUT PORT 2 BY PATH 2 |
| 550,614 OPEN<br>330,350,590,620,696 SHORTED<br>430,450,626,632,692,694 * | 632,696 OPEN<br>550,590,626,692,694 SHORTED<br>330,350,430,450,614,620 * | OUTPUT PORT 3 BY PATH 1 |
| 590,620 OPEN<br>430,450,550,614,626,696 SHORTED<br>330,350,632,692,694 * | 590,626 OPEN<br>430,450,550,620,632,696 SHORTED<br>330,350,614,692,694 * | OUTPUT PORT 3 BY PATH 2 |

* DOESN'T MATTER

Fig. 6b

MICROWAVE SIGNAL ROUTING MATRIX

BACKGROUND OF THE INVENTION

This invention relates to microwave signal routing matrices of the type having N inputs and M outputs and known as crosspoint or crossbar switches.

Crosspoint or crossbar switches have been used for many years in telephone applications in order to connect an arbitrary one of a plurality of inputs to an arbitrary one of a plurality of outputs. Such crosspoint switches are readily implemented at telephone frequencies, because the switching takes place within a region which is a small fraction of a wavelength in extent, and because the effect of reactances associated with the switching elements is small at telephone frequencies. It may be desirable to accomplish crosspoint switching at microwave frequencies, as for example to route signals around failed elements, for reconfiguring microwave circuits, or for reconfiguring the elements of an array antenna in order to select appropriate radiation characteristics.

Microwave signals are ordinarily carried by conductors configured in the form of a transmission line. The salient feature of a transmission line lies in the maintenance of a substantially constant distributed inductance and capacitance between the conductors along the length of the conductors. This is ordinarily accomplished by maintaining a fixed cross-sectional shape along the length of the conductors. FIG. 1*a* illustrates a transmission line of the coaxial (coax) type. This well known type of transmission line includes a hollow cylindrical outer conductor 12 centered on a longitudinal axis, together with a relatively thin center conductor 14 extending along the axis. As illustrated in FIG. 1*a*, center conductor 14 is connected to outer conductor 12 by a short-circuiting conductor 16 at the right-hand end, and is open at the left-hand end. As is well known in the art, the length in wavelengths along a transmission line equals the free-space wavelength at the frequency in question multiplied by a fraction representing the relative velocity of propagation along the transmission line, which is generally proportional to the square root of the effective dielectric constant. The illustrated length of the coaxial structure is an odd multiple of one-fourth wavelength, or more formally $$L=(2N+1)\lambda/4 \quad (1)$$

As is well known to those skilled in the art, the apparent impedance looking into the left side of transmission line 10 is an open circuit (infinite ohms) at a frequency for which the above condition exists. As the frequency departs from that at which the condition is exactly met, the impedance at the left end transmission line 10 decreases. When such circuits are used, their operation is normally specified to include a range of frequencies around the frequency for which Equation 1 holds.

FIG. 1*b* illustrates another type of transmission line known as microstrip. Microstrip transmission line 20 of FIG. 1*b* includes a flat dielectric plate 22 on the bottom side of which is fastened or deposited a conductive ground plane 24. A strip conductor 26 extends along the upper side of dielectric plate 22. As in the arrangement of FIG. 1*a*, one end of strip conductor 26 is connected by way of a conductive through path or via 28 to ground plane 24. At a point along strip conductor 26 of microstrip transmission line 20 which is at a distance $(2N+1)\ \lambda/4$ from via 28, the impedance is at a maximum. FIG. 1*c* is a symbolic representation of a coaxial transmission line specifically and transmission line in general.

U.S. Pat. No. 3,833,866 issued Sept. 3, 1974 to Boutelant describes a microwave switching matrix of the crosspoint type in which each crosspoint connection is made by a diode coupled between transmission lines. Biasing of the diode is accomplished by means of inductors configured as quarter-wavelength transmission lines. The Boutelant arrangement uses an isolator associated with each input port and with each output port to reduce the effect of standing waves attributable to reflections at the crosspoints. In one embodiment, Boutelant uses power dividers as isolators. Such isolators or power dividers introduce cost and loss penalties.

The arrangement of FIG. 2*a* illustrates a well known arrangement which provides the function of a single pole, double throw switch 200 for microwave signals. In the arrangement of FIG. 2*a*, a microwave source illustrated as an oscillator 210 is coupled by way of an input port 212 and a common input transmission 214 to a junction point 216. Junction point 216 is connected to a junction point 222 by way of a switchable output transmission line including portions 218*a* and 218*b* separated by a DC blocking capacitor 220. Junction point 222 is coupled by a further blocking capacitor 224 to an output port 226. While the terms input port and output port suggest a preferred direction for the flow of signal, those skilled in the art realize that the direction of signal flow is irrelevant, and the direction of signal flow and designation of the ports could as well be reversed.

A direct-current-passing, high-frequency rejecting filter illustrated as an inductor 228 is coupled at one end to junction point 222 in FIG. 2*a*. A switching diode 230 is connected between junction point 222 and ground. In this context, ground represents the ground plane or the outer conductor of the appropria&e transmission line. Junction point 216 is coupled to a junction point 242 by a transmission line including portions 238*a* and 238*b* separated by a blocking capacitor 240. Junction 242 is coupled by way of a blocking capacitor 244 to a switched output port 226. A low-pass, high-reject filter represented as an inductor 248 is coupled to junction point 242. A diode 250 is connected between junction point 242 and ground. Inductors 228 and 248 are connected to a switching control circuit illustrated as a block 250 which produces appropriate bias signals for diodes 230 and 250 for switching control. Junction points 222 and 242 are each one-fourth wavelength from junction point 216. It is expected that input and output ports are connected to sources and loads having impedances which are substantially matched to the characteristic impedances of the transmission lines over the frequency range of interest.

In operation, switching control circuit 250 applies current by way of either inductor 228 or 248 for forward-biasing one of diodes 230 or 250. When forward biased, the diode assumes a low impedance condition and effectively short-circuits between the conductors of the associated transmission line. As illustrated in FIG. 2*a*, the physical length of the diode symbol for a diode such as 230 is a significant proportion of the length of the transmission line represented by segments 218*a* and 218*b*. However, in actual practice, the physical length of the diode is very small by comparison with the quarter wavelength. In operation with one of diodes 230 or 250 forward-biased, the effective short circuit produced by the forward-biased diode appears as an open circuit or high-impedance condition at common junction point 216. The diode which is not forward biased remains open-circuited. It should be noted that the open circuiting of a diode such as diode 250 does not result in open-circuiting of the transmission line.

The transmission line to which the open-circuited diode is connected has its impedance established by the termination coupled to its output port. Signal from generator 210 flows to that output port which is associated with an open-circuited diode. That is, if diode 230 is forward biased and therefore a short circuit, and diode 250 is open circuited, signal flows from input port 212 to output port 2. Similarly, if diode 250 is forward biased and therefore short-circuited, and diode 230 is not biased and is therefore an open circuit, signal flows from common port 212 to output port 1. The arrangement of switch 200 has the advantages of simplicity and low through loss.

It should be noted that in the description of microwave circuits, switching elements such as diodes 230 and 250 may be represented as mechanical switches, such as illustrated in FIG. 2b. In FIG. 2b, switching diode 250 of FIG. 2a is symbolically represented by a corresponding mechanical switch symbol. When the symbolic representation is used, the biasing networks and blocking capacitors are not ordinarily shown.

The arrangement of FIG. 2a has a single input and two outputs. It would be very desirable to be able to connect an arbitrarily large number of input ports to an arbitrarily large number of output ports using a simple low-loss arrangement such as that of FIG. 2a. FIG. 2c is a redrawing of the arrangement of FIG. 2a to facilitate comparison of its topography with that of the invention.

SUMMARY OF THE INVENTION

A signal routing matrix for selectively providing signal paths between a plurality of input ports and a plurality of output ports includes a plurality of interconnects. Each interconnect includes first and second ends and is coupled between one of a set of node points mutually spaced by $\lambda/2$ (or an integer multiple thereof) along input transmission lines coupled to the input ports and one of a set of node points mutually spaced by $\lambda/2$ (or an integer multiple thereof) along output transmission lines coupled to the output ports. Each interconnect includes a controllable short-circuiting arrangement located $\lambda/4$ (or an odd multiple thereof) from the first and second ends of the interconnect. A control arrangement is coupled to all the controllable short-circuiting arrangements for individually controlling their states. The control arrangement, for each signal path between a selected input port and a selected output port by way of a corresponding input and output transmission line, short circuits at least all those short-circuiting arrangements associated with interconnects which are coupled at one end to the selected input and output transmission lines, and does not short-circuit that one interconnect connected at a first end to the selected input transmission line and at a second end to the selected output transmission line, thereby forming a signal path between the input and output transmission paths and isolating the input and output transmission lines from all other paths.

DESCRIPTION OF THE DRAWING

FIGS. 6a and 6b, referred to jointly as FIG. 6, illustrate a scheme in FIG. 6a for a $2\times3$ matrix which provides a redundant connection path which may be used by either of the two inputs, and in FIG. 6b the state of the redundant switches for various paths; FIG. 7b is a schematic diagram illustrating an embodiment utilizing the principles of the arrangement of FIG. 7a.

DESCRIPTION OF THE INVENTION

Figure 1A:
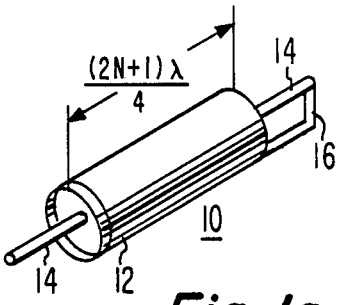
Fig. 1a PRIOR ART
FIGS. 1a, 1b and 1c, referred to jointly as FIG. 1, illustrate coaxial, microstrip, and symbolic transmission lines, all as known in the prior art.
Figure 1C:
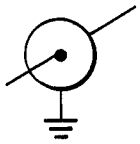
Fig. 1c PRIOR ART
Figure 1B:
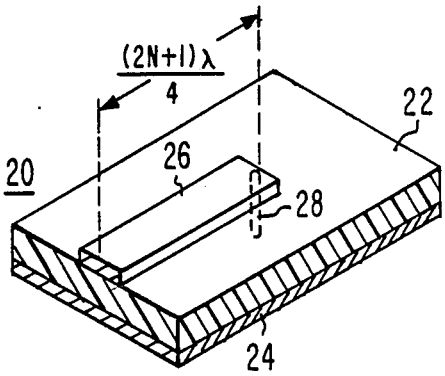
Fig. 1b PRIOR ART
Figure 2B:
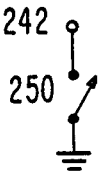
FIGS. 2a, 2b and 2b, referred to Jointly as FIG. 2, illustrate in FIG. 2a a prior art functional equivalent of a single pole, double throw switch using the properties of short-circuited, quarter-wavelength transmission lines to provide isolation and using diodes to perform the switching functions, and in FIG. 2b a symbolic representation of a switch such as one of the diodes in the arrangement of FIG. 2a, and in FIG. 2c a rearrangement of the functional portions of FIG. 2a using the symbol of FIG. 2b.
Figure 2A:
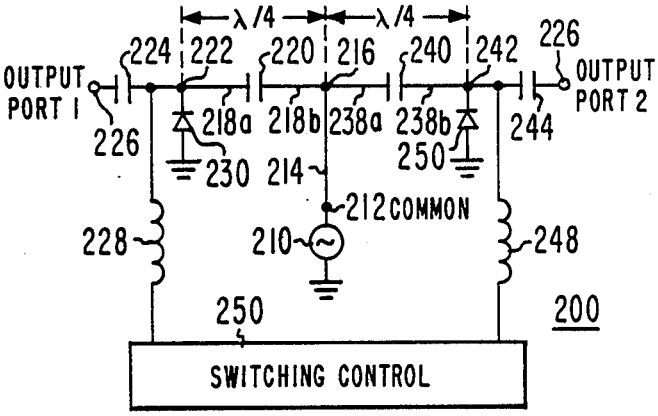
Fig. 2a PRIOR ART
Figure 2C:
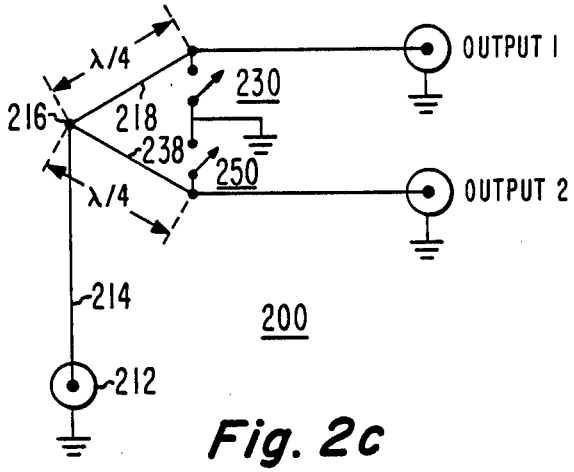
Fig. 2c PRIOR ART

FIG. 2c is a redrawing of the arrangement of FIG. 2a in a topological configuration which makes comparison with the invention easier. In FIG. 2c, elements corresponding to FIG. 2a are designated by the same reference numeral.

Figure 3:
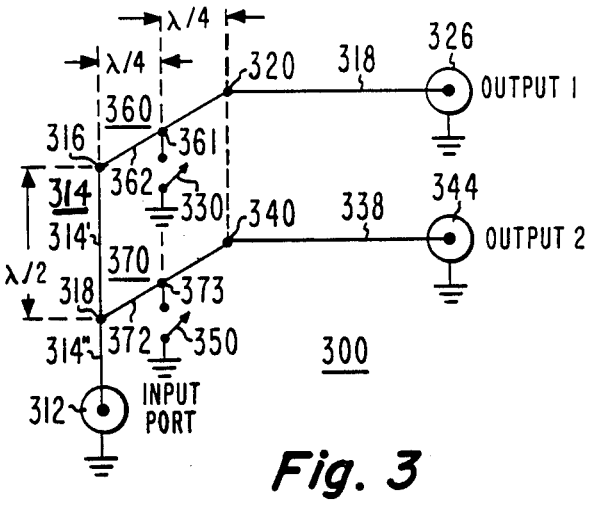
FIG. 3 illustrates a functional equivalent of the arrangement of FIGS. 2a or 2c using a structure according to the invention.

FIG. 3 illustrates an embodiment of the invention providing the same function as the arrangements of FIGS. 2a and 2c. In FIG. 3, a single-pole, double-throw switch 300 includes an input port 312 and an input transmission line designated generally as 314 including a first node point (node) 316 and a second node 318 spaced along its length. Input port 312 is coupled to node 318 by a portion 314" of input transmission line 314. Node points 316 and 318 are separated by a portion 314' of transmission line 314 having an electrical length of one-half wavelength at the center of the frequency of operation. A first output transmission line 318 has a first node point 320 at one end and a first output port 326 at its other end. A second output transmission line 338 has a first node 340 at one end and a second output port 344 at the other end. A first interconnection arrangement designated generally as 360 includes a transmission line having a first end connected to node 316 on input transmission line 314 and a second end connected to node 320 on output transmission line 318. Interconnection arrangement 360 also includes a switch 330 coupled to transmission line 362 for selectively short-circuiting transmission line 362 to ground at a location 361 which is one-fourth wavelength from both node points 316 and 320. Similarly, a further interconnection arrangement 370 includes a transmission line 372 having a first end connected to node 318 and a second end connected to node 340 on output transmission line 338. A switch 350 is connected to transmission line 372 at a point 373 one-fourth wavelength from each of node points 318 and 340 for selectively short-circuiting transmission line 372.

The arrangement of single-pole, double-throw switch 300 of FIG. 3 provides exactly the same function as switch 200 of FIG. 2. In order to couple signal from input port 312 to output port 326, switch 350 is closed or short-circuited, thereby producing a low impedance at point 373 at the center of transmission line 372 and therefore a high impedance or open circuit looking into transmission line 372 from either of node points 318 or 340. Consequently, a signal traversing input transmission line portion 314" from input port 312 goes past node point 318 to transmission line portion 314' without substantial loss and continues to node point 316. Switch 330 is maintained open, which allows signal to flow from node point 316 along transmission line 362 to node point 320, and from node point 320 along output transmission line 318 to first output port 326. Thus, with switch 350 shorted and switch 330 open, signal is routed from input port 312 to first output port 326 and not to second output port 344. Similarly, in order to route a signal from input port 312 to second output port 344, switch 330 is closed to short-circuit point 361 on transmission line 362, and configuration, the short-circuit at the center of transmission line 362 produces an open-circuit condition at node point 316. Node point 316 is at an electrical distance of one-half wavelength from node point 318, and the open circuit condition or high impedance a& node point 316 is repeated at node point 318. Therefore, the closing or shorting of switch 330 causes signal applied to input port 312 and progressing along input transmission line portion 314" to flow onto transmission line 372 of interconnection arrangement 370, and not onto portion 314' of input transmission line 314. The signal flowing onto transmission line 372 reaches second output 344 by way of node point 340 and output transmission line 338.

The significant difference between the arrangement of FIG. 3 and the arrangement of FIG. 2*c* is the connection of the short-circuiting switches at the centers of interconnect lines, $\lambda/4$ from node points, and the separation of node points by $\lambda/2$. This difference results in an ability to expand the structure, as described in conjunction with FIG. 4.

Figures 4A, 4B:
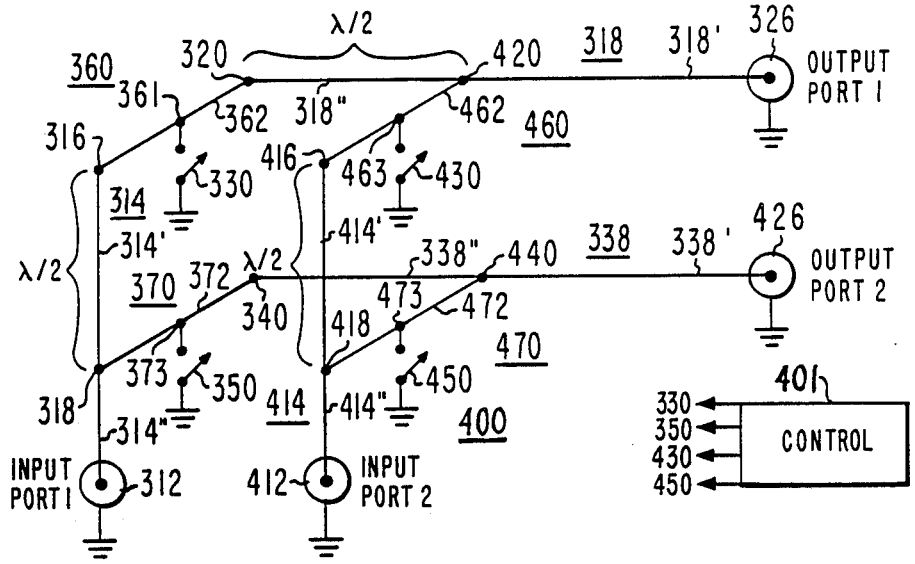
FIGS. 4a and 4b, referred to together as FIG. 4, represent in FIG. 4a a structure of transmission lines and switches which together form a two-input, two-output ($2\times2$) signal routing matrix, and list in FIG. 4b lists the switch states for various routings.

FIG. 4*a* illustrates a structure 400 which constitutes a $2\times2$ matrix, which allows a signal to be routed from either input port to either output port. Substantial portions of the arrangement of FIG. 4*a* correspond exactly with the arrangement of FIG. 3, and elements of FIG. 4 corresponding to those of FIG. 3 are designated by the same reference numerals. The arrangement of FIG. 4*a* differs from that of FIG. 3 by including a second input port 412 connected to a second input transmission line designated generally as 414 and including a first portion 414' separated from a second portion 414" by a node point 418. Second input transmission line 414 ends at a node point 416. Node points 418 and 416 are separated by one-half wavelength. A second node point 420 is located at a point on output transmission line 318 separated from node point 320 by one-half wavelength, which separates first output transmission line 318 into portions 318' and 318".

Similarly, a further node point 440 is located on second output transmission line 338 and divides transmission line 338 into portions 338' and 338". Node points 340 and 440 are separated by one-half wavelength. The arrangement of FIG. 4*a* also differs from the arrangement of FIG. 3 by including two further interconnection arrangements 460 and 470. Interconnection arrangement 460 includes a transmission line 462 having a first end connected to node point 416 on second input transmission line 414 and a second end connected to node point 420 on first output transmission line 318. A short-circuiting switch 430 is located at a point 463 midway along transmission line 462, $\lambda/4$ from its ends. Interconnection arrangement 470 includes a transmission line 472 having a first end connected to node point 418 on second input transmission line 414, and a second end connected to node point 440 on second output transmission line 338. A short-circuiting switch 450 is connected at a point 473 midway along transmission line 472, $\lambda/4$ from each of node points 418 and 440.

FIG. 4*a* includes a control arrangement 401 coupled to the various switches 330, 350, 430, 450 for controlling their state. The coupling may be by electrical conductors (not completely illustrated) when shorting diodes are used to implement the switches. The control arrangement includes a memory (not illustrated) which stores the information in the table of FIG. 4*b* to generate bias signals for switch control. The memory may be accessed by a combination of an N-bit and an M-bit address word.

FIG. 4*b* is a table describing the states of the various switches which are required to establish signal paths between the various input and output ports of matrix 400. of FIG. 4*a*. In general, the switches of all interconnect arrangements which terminate at either end on the input transmission line associated with the selected input port or on the output transmission line associated with the selected output port are short-circuited, and that one switch arrangement associated with the particular interconnect arrangement which interconnects the selected input and output transmission lines is open circuited. For example, assume that the N-bit address word is 01 and the M-bit address word is 01, representing selection of a path from input port 1 to output port 1. The memory in control 401 of FIG. 4*a* is explained by reference to FIG. 4*b*. In FIG. 4*b*, the switch positions are shown at the intersection of the "FROM INPUT PORT 1" row and the "TO OUTPUT PORT 1" column. It is noted that switches 350 and 430 are closed for short-circuiting the associated interconnect arrangement, and switch 330 is open. This may be understood by considering that the path between input port 1 and output port 1 must include transmission line 362 of interconnect arrangement 360, and therefore switch 330 must be open to allow signal to flow.

On the other hand, the signal flowing by input transmission line 314, interconnect path 360 and output transmission line 318 must not be shunted away onto any other conductors, and therefore switch 350 must be shorted to present an open circuit at node point 318, and switch 430 must be short-circuited to present an open circuit at node point 420. The state of switch 450 is immaterial as indicated by the asterisk (*) in FIG. 4*b*, because no signal appears on output conductor 318 which can be affected by switch 450. This is also referred to as a "doesn't matter" or a "don't care" condition.

As a further example, in order to produce a signal path between input port 2 and output port 2, switch 450 is opened to allow signal to flow over transmission line 472 of interconnect arrangement 470. Switch 350 must be short-circuited to present a open circuit at node point 340 which is repeated at node point 440, one-half wavelength away. This prevents the flow of signal from node point 440 onto transmission line section 338''. Switch 430 is closed to produce an open circuit at node point 416, which is repeated at node point 418 for preventing signal from flowing onto transmission line 414'. Thus, the low loss path from second input port 412 to second output port 426 includes transmission line portion 414'', transmission line 472 and transmission line portion 338'.

The state of switch 330 has no effect on the signal path between input port 2 and output port 2. It should be noted that switches 350 and 430 are shorted in order to produce a signal path between input port 1 and output port 1, and also to produce a signal path between input port 2 and output port 2. For the first-mentioned path, switch 330 is open and the state of switch 450 is not relevant. For the second-mentioned path, switch 450 is open and the state of switch 330 is not relevant. Consequently, it is possible to simultaneously establish two separate, independent paths between input port 1 and output port 1, and between input port 2 and output port 2, by short-circuiting switches 350 and 430, and by placing switches 330 and 450 into the open condition.

Reference to FIG. 4b provides the switch conditions for establishing paths between input port 1 and output port 2, and between input port 2 and output port 1. Since these switch conditions are not mutually exclusive, it is also possible to simultaneously establish separate, independent paths between input port 1 and output port 2, and between input port 2 and output port 1.

Figures 5A, 5B:
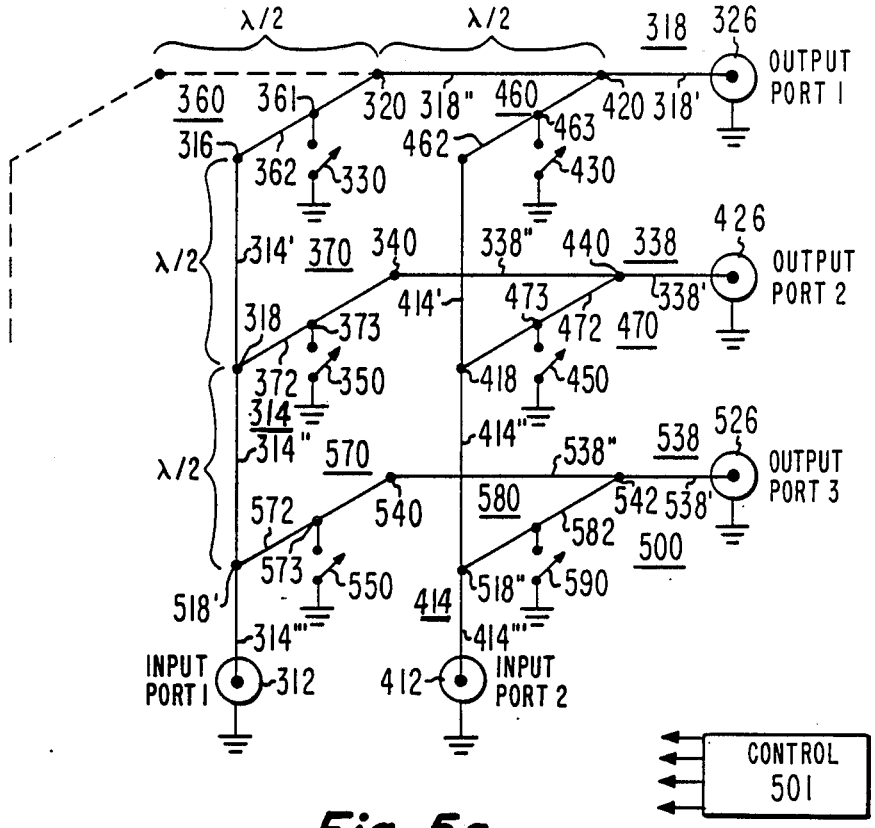
FIGS. 5a, 5b and 5c, referred to together as FIG. 5, represent in FIG. 5a an extension of the structure of FIG. 4a to two inputs and three outputs, and in FIG. 5b indicates the states of the switches for various input-output routings, and FIG. 5c also provides an understanding of how the matrix may be extended to an $M\times N$ structure.

Matrix arrangement 500 of FIG. 5a extends the arrangement of matrix 400 to two inputs and three outputs (2×3). Elements of FIG. 5a corresponding to those of FIG. 4a are designated by the same reference numbers. Matrix 500 includes a further portion 314''' of first input transmission line 314, and which is separated from portion 314'' by a node point 518'. Portion 314''' is connected to input port 312. Transmission line portion 314'' has an electrical length of λ/2. Similarly, second input port 412 is connected by a transm-ission line portion 414''' to a node 518'', which is connected to transmission line portion 414''. The electrical length of transmission line portion 414'' is λ/2. Matrix 500 also includes a third output port 526 connected to a third output transmission line designated generally as 538, which includes a first portion 538' lying between port 546 and a node 542, and a second portion 538'' connecting node 542 to a further node 540. The seperation between nodes 540 and 542 is λ/2. An interconnect arrangement 570 includes a transmission line 572 connected at one end to node 518' on first input transmission line 314 and connected at a second end to node 540 on third output transmission line 538. As in the case of the other interconnect arrangements, interconnect arrangement 570 has a switch 550 connected to a point 573, which is λ/4 from node points 518' and 540. Another interconnect arrangement 580 including a transmission line 582 and a switch 590 extends from node point 518'' on second input transmission line 414 to node point 542 on third output transmission line 538. A control arrangement illustrated as a block 501 controls the switches using memorized information detailed in conjunction with FIG. 5b.

FIG. 5b tabulates the switch states for establishing a path between either input port and any of the output ports of matrix 500 of FIG. 5a. As an example of the meaning of the tabulation of FIG. 5b, consider the switch states necessary to form a path between the second input port 412 and the second output port 426. The only interconnection between second input transmission line 414 and second output transmission line 338 is interconnect arrangement 470. Consequently, the signal must traverse transmission line 472, and therefore switch 450 must be open, as indicated at the intersection of the INPUT PORT 2 row and OUTPUT PORT 2 column in FIG. 5b. Since signal is traversing at least portions of second input transmission line 414, all interconnect arrangements other than 470 which terminate on transmission line 414 must look like open circuits for preventing loss This is accomplished by setting switches 430 and 590 to a shorted condition, as indicated in FIG. 5b for the input port 2-output port 2 path. Shorting of switch 590 makes the input impedance looking into interconnect arrangement 580 appear very high, so signal from input port 412 continues to flow from transmission line portion 414''' to portion 414'' without significant loss. Shorting of switch 430 causes an open circuit to be presented at node 418, which is 3λ/4 away from switch 430. Since signal flows on second output transmission line 338, it must be routed toward second output port 426. This is accomplished by setting switch 350 to a short circuit condition (see FIG. 5b), which causes transmission line portion 338'' to appear to be a high impedance when viewed from node point 440. The signal passes node 440 without significant loss and flows along transmission line portion 338' to the matched termination (not illustrated) coupled to second output port 426. Since no significant amount of signal appears on first input transmission line 314 or on first or third output transmission lines 318 and 438, the states are not relevant of those switches associated with interconnects terminating at both ends on one of transmission lines 314, 318 or 538.

It will be noted that for the input port 2 to output port 2 path, both switches 330 and 550 are marked with an asterisk. This means that another signal path may be simultaneously established in matrix 500. The extra paths are those in the table of FIG. 5b in which either switches 330 or 5S0 are indicated as open, and in which switch 450 (already being used for the input port 2 to output port 2 path) is indicated with an asterisk. This condition is met for the path from input port 1 to output port 1, and for the path from input port 1 to output port 3.

Figure 5C:
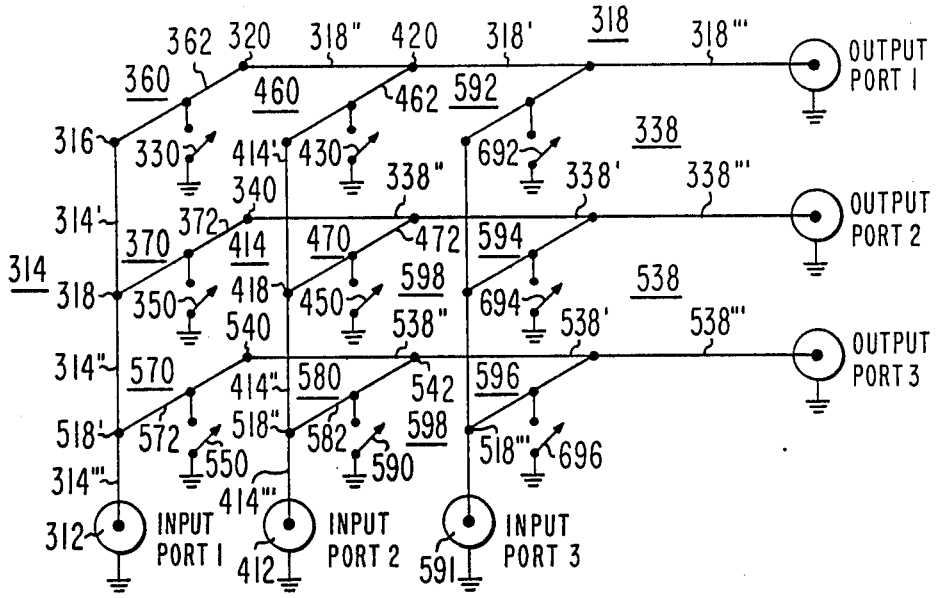

FIG. 5c is similar to FIG. 5a, but extends the matrix to a 3×3 configuration. Elements of FIG. 5c corresponding to those of FIG. 5a are designated by the same reference numbers. The 3×3 matrix of FIG. 5c differs from the 2×3 matrix of FIG. 5a in that it includes a third input port 591 and a third input transmission line 598. Interconnect arrangements 592, 594 and 596 similar to the other interconnect arrangements are coupled between λ/2-spaced nodes along third input transmission line 598 and λ/2-spaced node points lying along first, second and third output transmission lines 318, 338 and 538, respectively.

Figure 6A:
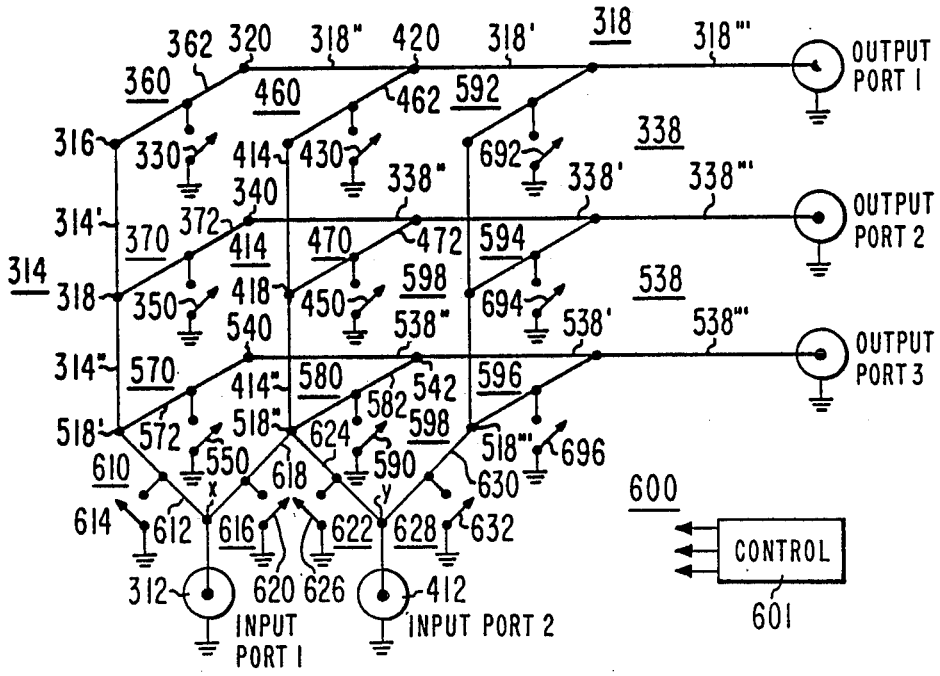

FIG. 6a illustrates a second 2×3 routing matrix 600 which provides redundant paths between input and output ports, to provide high reliability in case a switch fails. The arrangement of FIG. 6*a* is similar to that of FIG. 5*c*, and elements of FIG. 6*c* corresponding to those of FIG. 5*c* are designated by the same reference numbers. Matrix 600 differs from that of FIG. 5*c* in that third input port 591 is discarded, and in that first input port 312 is coupled to both first and second input transmission lines 314 and 414 at nodes 518' and 518'', respectively, and in that second input port 412 is coupled to both second and third input transmission lines 414 and 598 at node points 518'' and 518''', respectively. In effect, the first and second input ports each have exclusive use of one input transmission line (314 for input port 312, 598 for input port 512), and they both have access to input transmission line 414.

More particularly, first input port 312 is coupled to node 518' on first input transmission line 314 by an interconnect arrangement 610, which includes transmission line 612 and a switch 614. Switch 614 is arranged to controllably short-circuit transmission line 612 λ/4 from node 518' and λ/4 from a node X.

In the illustration of FIG. 6*a*, node X is separated from input port 312 for clarity of illustration, but in practice they will ordinarily be congruent. No distinction is made hereinafter between input port 312 and node X, or between a corresponding node Y and input port 412. First input port 312 is also connected to second input transmission line 414 by an interconnect arrangement 616 which includes a transmission line 618 and a switch 620 spaced λ/4 from node point 518'' and from first input port 312. Second input port 412 is coupled to node 518'' by an interconnect arrangement 622, including switch 626 arranged for shorting transmission line 624 at a point λ/4 from both node 518'' and input port 412. Second input port 412 is coupled to third input transmission line 598 at node 518''' by interconnect 628, including transmission line 630 and λ/4 spaced switch 632. Control arrangement 601 controls the various switches to establish signal routing, and includes memories which store the information of FIG. 6*b*.

The table of FIG. 6*b* indicates the switch states for establishing various redundant input-output paths. FIG. 6*b* is self-explanatory in view of the tables of FIGS. 4*b* and 5*b*.

Figure 7A:
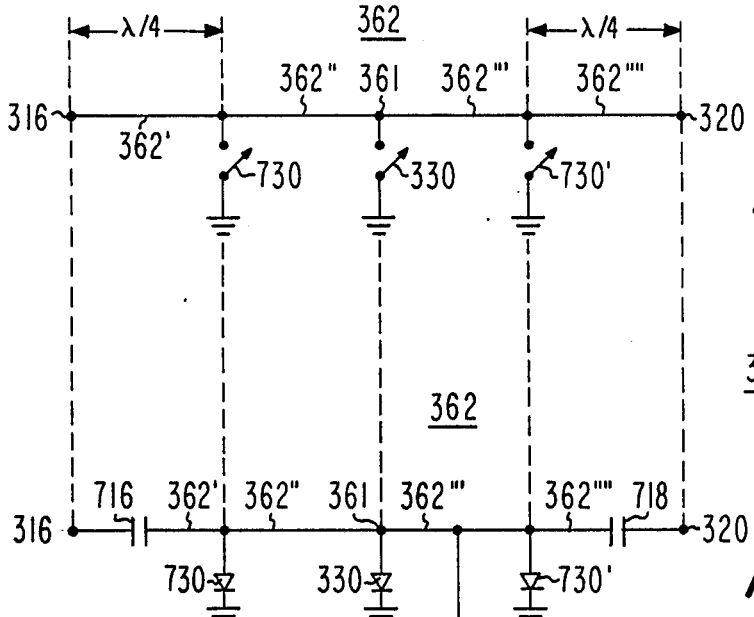
FIG. 7a illustrates in schematic form the principles of an alternative interconnection path structure useful in any of the arrangements of FIGS. 3, 4, 5 or 6, which provides improved isolation.
Figure 7B:
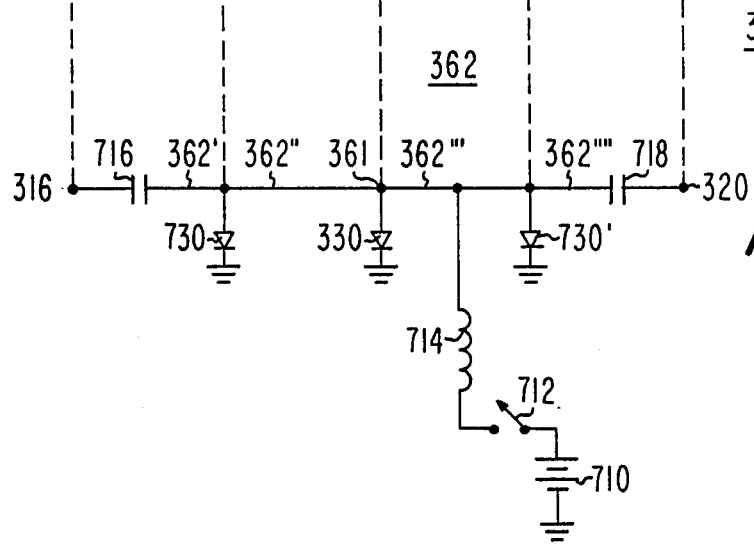

FIG. 7*a* illustrates schematically an alternative embodiment of an interconnect arrangement which may be used in the arrangements of FIGS. 3, 4*a*, 5*a*, 5*c* or 6*a*. For definiteness, FIG. 7*a* illustrates interconnect arrangement 360, and elements of FIG. 7*a* corresponding to those of earlier FIG. are designated by the same reference numbers. In FIG. 7*a*, interconnect arrangement 360 is illustrated as having a transmission line 362 divided into four portions 362', 362'', 362''' and 362''''. Transmission line portion 362' ends at node point 316 and portion 362'''' ends at node point 320. Interconnect arrangement 360 as illustrated in FIG. 7*a* differs from earlier representations in that it includes not only shorting switch 330 connected to central node point 361, but also includes additional shorting switches 730 and 730'. As illustrated in FIG. 7*a*, transmission line 362 has an electrical length greater than λ/4. Switch 730 is located between transmission line portions 362' and 362'', and switch 730' is located between portions 362''' and 362''''. Transmission line portions 362' and 362'''' each have an electrical length of λ/4. If portions 362'' and 362''' each also have a length of λ/4, a substantial improvement in the achievable isolation results. FIG. 7*b* illustrates an embodiment of the arrangement of FIG. 7*a* using diodes for the switches, and also including a bias source illustrated as a battery 710 coupled by a control switch 712 and an inductor 714 to a point along transmission line 362. The bias is decoupled from node point 316, 320 by series blocking capacitors 716 and 718.

Other embodiments of the invention will be apparent to those skilled in the art. In particular, other types of transmission lines may be used, such as stripline. Various types of diodes may be used for shorting, as for example PIN diodes. Instead of diodes, other active devices may be used as switches, as for example FET switches.

What is claimed is:

1. A signal matrix, comprising:

first and second input ports, associated with elongated first and second input transmission lines, respectively, each of said first and second input transmission lines being associated with a plurality of node points spaced along its length, each node point of said plurality of node points associated with one of said input transmission lines being spaced from its neighboring node points along its associated input transmission line by a distance equal to a nonzero integer multiple of one-half wavelength at a frequency within the operating frequency range;

first and second output ports, associated with elongated first and second output transmission lines, respectively, each of said first and second output transmission lines being associated with a plurality of node points spaced alng its length, each node point of said plurality of node points associated with one of said output transmission lines being spaced from its neighboring node points along its associated transmission line by a distance equal to a nonzero integer multiple of one-half wavelength at about said frequency;

first interconnection means comprising a first interconnecting transmission line coupled at a first end to a first one of said node points of said first input transmission line and at a second end to a first one of said node points of said first output transmission line, said first interconnection means further comprising first controllable short-circuiting means coupled to said first interconnecting transmission line for short-circuiting said first interconnecting transmission line at locations spaced from said first and second ends of said first interconnecting transmission line by a distance equal to an odd integer multiple of one quarter wavelength at about said frequency;

second interconnection means comprising a second interconnecting transmission line coupled at a first end to a second one of said node points of said first input transmission line and at a second end to a first one of said node points of said second output transmission line, said second interconnection means further comprising controllable second short-circuiting means coupled to said second interconnecting transmission line for controllably short-circuiting said second interconnecting transmission lines at locations spaced from said first and second ends of said second transmission line by a distance equal to an odd integer multiple of one quarter wavelength at about said frequency;

third interconnection means comprising a third interconnecting transmission line coupled at a first end to a first one of said node points of said second input transmission line and at a second end to a second one of said node points of said first output transmission line, said third interconnection means further comprising a third controllalle short-circuiting means coupled to said third interconnecting transmission line at locations spaced from said first and second ends of said third interconnecting transmission line by a distance equal to an odd integer multiple of one quarter wavelength at about said frequency;

fourth interconnection means comprising a fourth interconnecting transmission line coupled at a first end to a second one of said node points of said second input transmission line and at a second end to a second one of said node points of said second output transmission line, said fourth interconnection means further comprising a fourth controllable short-circuiting means coupled to said fourth interconnecting transmission line for controllably short-circuiting said fourth interconnecting transmission line at locations spaced from said first and second ends of said fourth interconnecting transmission line by a distance equal to an odd integer multiple of one-fourth wavelength at about said frequency; and first control means coupled to said first, second, third and fourth short-circuiting means for selecting one of (a) short-circuiting at least said second and third short-circuiting means and not short-circuiting said first short-circuiting means in a first mode to form a path for the flow of signal from said first input port and said first input transmission line to said first output transmission line and said first output port, (b) short-circuiting at least said first and fourth short-circuiting means and not short-circuiting said second short-circuiting means in a second mode to form a path for the flow of signal from said first input port and said first input transmission line to said second output transmission line and said second output port, (c) short-circuiting at least said first and fourth short-circuiting means and not short-circuiting said third short-circuiting means in a third mode to form a path for the flow of signal from said second input port and said second input transmission line to said first output transmission line and said first output port, and (d) short-circuiting at least said second and third short-circuiting means and not said fourth short-circuiting means in a fourth mode to form a path for the flow of signal from said second input port and said second input transmission line to said second output transmission line and second output port, whereby a path can be selectably established between one of said first and second input ports and one of said first and second output ports.

2. A matrix according to claim 1, wherein said first short-circuiting means comprises first and second shorting diodes coupled across said first interconnecting transmission line at locations spaced from said first and second ends, respectively, equal to an odd integer multiple of one quarter wavelength at about said frequency.

3. A matrix according to claim 2, wherein said first and second shorting diodes are spaced apart by a distance equal to one-half wavelength at about said frequency, and further comprising:

a third shorting diode located midway between said first and second diodes.

4. A matrix according to claim 2 wherein said first control means comprises direct bias current supply means coupled to said first and second shorting diodes for supplying bias current to said first and second shorting diodes during those intervals in which said first short-circuiting means is short-circuiting and for not supplying bias current to said first and second shorting diodes when said first short-circuiting means is not short-circuiting.

5. A matrix according to claim 4 further comprising direct current blocking means coupled between said first shorting diode and said first end of said first interconnecting transmission line and second direct current blocking means coupled between said second shorting diode and said second end of said first interconnecting transmission line for preventing said direct bias current applied to said first and second shorting diodes from being diverted away from said first short-circuiting means.

6. A matrix according to claim 1, wherein said first input transmission line ends at said first one of said node points of said first input transmission line, said second input transmission line ends at said first one of said node points of said second input transmission line, said first output transmission line ends at said first one of said node points of said first output transmission line, and said second output transmission line ends at said first one of said node points of said second output transmission line.

7. A matrix according to claim 1, further comprising:

a third output port and an associated elongated third output transmission line, said third output transmission line being associated with a plurality of node points spaced along its length, each node point of said plurality of node points associated with said third output transmission line being spaced from its neighboring node points along said third output transmission line by a distance equal to a nonzero integer multiple of one-half wavelength at about said frequency;

fifth interconnection means comprising a fifth interconnecting transmission line coupled at a first end to a third of said node points of said first input transmission line and at a second end to a first one of said node points of said third output transmission line, said fifth interconnection means further comprising a fifth short-circuiting means coupled to said fifth interconnecting transmissionline for controllably short-circuiting said fifth interconnecting transmission line at locations spaced from said first and second ends of said fifth interconnecting transmission line by a distance equal to an odd integer multiple of one quarter wavelength at about said frequency;

sixth interconnection means comprising a sixth interconnecting transmission line coupled at a first end to a third of said node points of said second input transmission line and at a second end to a second one of said node points of said third output transmission line, said sixth interconnection means further comprising a sixth short-circuiting means coupled to said sixth interconnecting transmission line for controllably short-circuiting said sixth interconnecting transmission line at locations spaced from said first and second ends of said sixth interconnecting transmission line by a distance equal to an odd integer multiple of one quarter wavelength at about said frequency; and further control means coupled to said fifth and sixth short-circuiting means for selective one of (e) short-circuiting at least said fifth short-circuiting means when said first control means is in one of said first and second modes, and also in a fifth mode to form a path for the flow of signal from said second input port and said second iu[put transmission line to said third output transmission line and said third output port and (f) short-circuiting at least said sixth short-circuiting means when said first control means is in one of said third and fourth modes, and also in a sixth mode to form a path for the flow of a signal from said first input port and said first input transmission line to said third output port by way of said third output transmission line.

8. A matrix according to claim 7, further comprising means for providing alternative paths for the flow of signal from said first input port to any of said output ports, comprising:

a first switchable transmission path including a first switchable transmission line coupled at a first end to said first input port and at a second end to one of said first and third node points of said first input transmission line, said first switchable transmission path further comprising a controllable seventh short-circuiting means coupled to said first switchable transmission line for controllably short-circuiting said first switchable transmission line at locations spaced from said first and second ends of said first switchable transmission line by a distance equal to an odd integer multiple of one-fourth wavelength at about said frequency:

a second switchable transmission path including a second switchable transmission line coupled at a first end to said first input port and at a second end to one of said first and third node points of said second input transmission line, said second switchable transmission path further comprising a controllable eighth short-circuiting means coupled to said second switchable transmission line at locations spaced from said first and second ends of said second switchable transmission line by a distance equal to an odd integer multiple of one quarter wavelength at about said frequency;

a third switchable transmission path including a third switchable transmission line coupled at a first end to said second input port and at a second end to said one of said first and third node points of said second input transmission line, said third switchable transmission path further comprising a controllable ninth short-circuiting means coupled to said third switchable transmission line at locations spaced from said first and second ends of said third switchable transmission line by a distance equal to an odd integer multiple of one-fourth wavelength at about said frequency; and path control means coupled to said first, second and third switchable transmission paths for, in a first operating state, short-circuiting at least said eighth short-circuiting means and not said seventh short-circuiting means in order to provide a path for the flow of signal from said first input port to one of said first, second and third output ports by way of said first input transmission line, and for, in a second operating state, short-circuiting at least said seventh short-circuiting means and not said eighth short-circuiting means in order to provide a path for the flow of signal from said first input port to one of said first, second and third output ports by way of said second input transmission line.

9. A signal matrix for selectively providing signal paths between a plurality of input transmission lines and a plurality of output transmission lines, comprising:

a plurality of interconnection means, each including first and second ends, and each being coupled between a node point on one of said input transmission lines and a node point on one of said output transmission lines, all said node points on any one of said input and output transmission lines being spaced by an integer multiple of one-half wavelength at the operting frequency;

a plurality of shorting means, each associated with one of said interconnection means, for selectively short-circuiting the associated interconnection means at a distance of an odd integer multiple of one-fourth wavelength at the operating frequency from said first and second ends of said associated interconnection means; and control means coupled to said shorting means for selecting a signal path including one of said input transmission lines and one of said output transmission lines, and for short-circuiting all of said shorting means associated with an interconnection means which is coupled at one and only one end to one of (a) the selected one of said input transmission line and (b) the selected one of said output transmission line, and for not short-circuiting that one of said shorting means associated with an interconnection means which is coupled at its first and second ends between the selected one of said input transmission lines and the selected one of said output transmission lines.

10. A signal matrix comprising:

a plurality of first transmission lines for propagating signal, each of said plurality of first transmission lines including a plurality of first node points mutually separated by one half wavelength at a frequency near the center of an operating frequency band;

a plurality of second transmission lines for propagating signal, each of said plurality of second transmission lines including a plurality of second node points mutually separated by one half wavelength at said frequency;

a plurality of interconnection means, each of said interconnection means comprising an interconnecting transmission line coupled at a first end to one of said first nodes and at a second end to one of said second nodes, each of said interconnection means further comprising controllable switch means associated with each of said interconnecting transmission lines, and arranged for short-circuiting said associated interconnecting transmission line at least at locations one-fourth wavelength from said first and second ends at a frequency with said band of operating frequencies; and control means coupled to said controllable switch means for closing all of said controllable switch means except one, which is maintained open, whereby signal may be coupled between those of said first and second transmission lines having in common that one of said interconnection means having an open controllable switch means.

* * * * *